US010179675B2

(12) United States Patent
Velmont et al.

(10) Patent No.: US 10,179,675 B2
(45) Date of Patent: Jan. 15, 2019

(54) DISPENSING CONTAINER WITH INTERIOR ACCESS

(71) Applicants: Rashon Velmont, Montebello, CA (US); Sebastian Velmont, Montebello, CA (US)

(72) Inventors: Rashon Velmont, Montebello, CA (US); Sebastian Velmont, Montebello, CA (US)

(73) Assignee: Velmont & Company, Inc., Montebello, CA (US)

( * ) Notice: Subject to any disclaimer, the term of this patent is extended or adjusted under 35 U.S.C. 154(b) by 0 days.

(21) Appl. No.: 16/019,232

(22) Filed: Jun. 26, 2018

(65) Prior Publication Data

US 2018/0334296 A1 Nov. 22, 2018

Related U.S. Application Data

(63) Continuation-in-part of application No. 15/011,424, filed on Jan. 29, 2016, which is a continuation-in-part of application No. 14/134,224, filed on Dec. 19, 2013, now abandoned.

(51) Int. Cl.

| | |
|---|---|
| ***B65D 81/00*** | (2006.01) |
| ***B65D 43/16*** | (2006.01) |
| ***B65D 23/00*** | (2006.01) |
| ***B65D 85/80*** | (2006.01) |
| ***B65D 81/32*** | (2006.01) |
| ***B65D 81/38*** | (2006.01) |
| *B65F 1/16* | (2006.01) |

(52) U.S. Cl.

CPC ..... *B65D 43/166* (2013.01); *B65D 23/00* (2013.01); *B65D 81/3205* (2013.01); *B65D 81/3876* (2013.01); *B65D 85/80* (2013.01); *B65D 2231/005* (2013.01); *B65D 2251/1025* (2013.01); *B65F 1/1615* (2013.01)

(58) Field of Classification Search

CPC .. B65D 43/166; B65D 23/00; B65D 81/3205; B65D 81/3876; B65D 85/80; B65D 2231/005; B65D 2251/1025; B65F 1/1615

USPC ..... 215/215

See application file for complete search history.

(56) References Cited

U.S. PATENT DOCUMENTS 1,434,460 A * 11/1922 Tibbatts ..... A61J 9/00 215/11.1
2,328,543 A * 9/1943 Bauman ..... A45F 3/20 206/217
2,859,891 A * 11/1958 Carkin ..... A61J 9/001 215/11.3
3,043,354 A * 7/1962 Fitzgerald ..... B65D 25/04 16/225
3,061,129 A * 10/1962 Fitzgerald ..... A61J 9/001 215/11.3
3,101,154 A * 8/1963 Herdering ..... B65D 11/188 217/65
3,142,422 A * 7/1964 Mojonnier ..... B65D 21/0231 206/509

(Continued)

*Primary Examiner* — Ernesto Grano

(57) ABSTRACT

A dispensing container with interior access for when the said dispensing container can no longer disperse the low level content within its bottom surface and interior walls through its normal dispensing process the dispensing container with interior access can be opened through its adjoining halves for complete access to its remaining content.

5 Claims, 14 Drawing Sheets

(56) References Cited

Figure 1A:
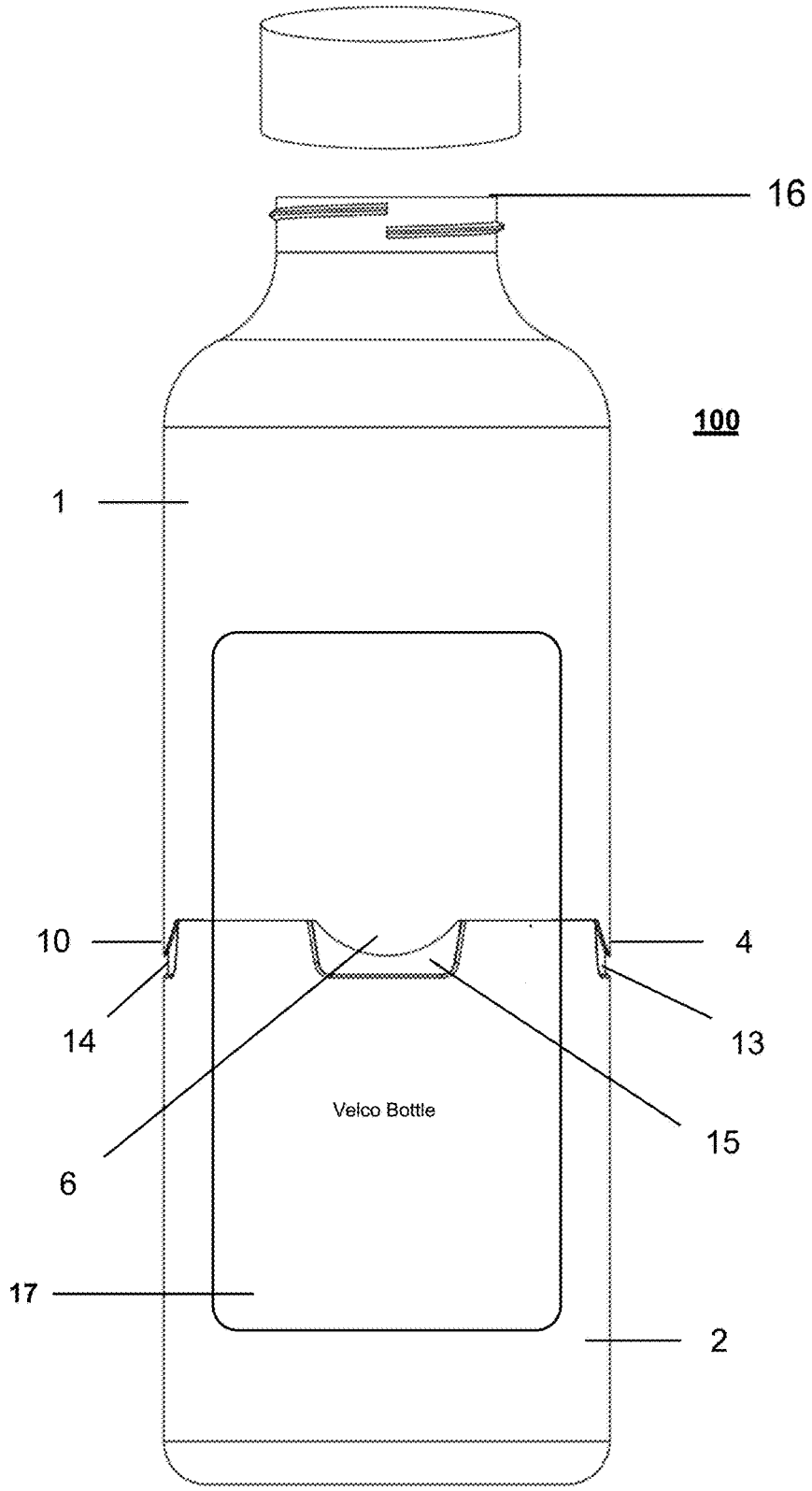

U.S. PATENT DOCUMENTS 3,380,608 A * 4/1968 Morbeck ..... B29C 65/00 215/296
3,485,408 A * 12/1969 Benesch ..... B65F 1/12 220/326
4,219,125 A * 8/1980 Wiltshire ..... B65D 90/08 220/320
4,393,974 A * 7/1983 Levesque ..... A45C 11/00 206/37
D272,223 S * 1/1984 Daenen ..... D7/629
4,533,057 A * 8/1985 Klittich ..... A61J 9/001 215/11.3
4,546,874 A * 10/1985 Kirchhan ..... B65D 53/02 220/4.22
4,610,394 A * 9/1986 Bryson ..... A61L 9/12 220/4.23
4,809,874 A * 3/1989 Pehr ..... B65D 43/164 215/235
4,905,857 A * 3/1990 Her ..... A45C 11/22 190/28
4,931,329 A * 6/1990 Sun ..... A01G 29/00 215/317
5,072,851 A * 12/1991 Wilkes ..... B01D 35/30 220/203.09
5,211,302 A * 5/1993 Tiramani ..... A45C 13/04 206/581
5,261,554 A * 11/1993 Forbes ..... A45C 11/20 220/592.16
5,396,747 A * 3/1995 Breuning ..... E04B 5/04 52/516
5,503,274 A * 4/1996 Toffler ..... A63H 3/50 206/457
5,655,677 A * 8/1997 Fratello ..... B65G 51/06 220/4.22
5,671,856 A * 9/1997 Lisch ..... A01K 97/06 206/519
D387,197 S * 12/1997 Huang ..... D3/271.1
5,740,940 A * 4/1998 Weiss ..... B65D 81/3886 220/326
5,833,069 A * 11/1998 Jones ..... B65D 81/03 206/522
5,878,907 A * 3/1999 Graf ..... B65D 11/06 220/324
5,960,998 A * 10/1999 Brown ..... B05B 11/0005 222/131
6,050,438 A * 4/2000 Kovens ..... B65D 11/02 220/4.24
6,061,939 A * 5/2000 Gildea ..... G09F 15/0037 40/538
6,062,412 A * 5/2000 Jacobsmeyer, Jr. ..... B65F 1/16 150/154
6,155,452 A * 12/2000 Laurent ..... B65D 81/3876 220/711
6,223,960 B1 * 5/2001 Powell ..... B62J 9/00 190/125
6,237,788 B1 * 5/2001 Shuen ..... A61L 9/12 206/457
6,247,612 B1 * 6/2001 Kaufman ..... G07F 9/02 206/278
6,415,915 B1 * 7/2002 Grossman ..... A45C 11/04 206/45.23
6,629,618 B1 * 10/2003 Volan ..... A47G 19/2288 215/12.1
6,739,475 B2 * 5/2004 San Martin ..... G07F 17/0071 220/4.23
6,938,805 B2 * 9/2005 Brincat ..... B65D 1/06 222/212
7,097,069 B2 * 8/2006 Cavanagh ..... B65D 7/04 206/217
7,114,624 B2 * 10/2006 Van Parys ..... B65D 23/0885 215/12.1
7,597,226 B2 * 10/2009 Starr ..... B67B 7/92 225/103
D617,097 S * 6/2010 Raile ..... D3/263
D617,554 S * 6/2010 Raile ..... D3/263
D623,407 S * 9/2010 Raile ..... D3/263
D639,449 S * 6/2011 Luburic ..... E04B 5/328 D25/1
7,959,025 B2 * 6/2011 Salice ..... B65D 43/162 220/4.01
7,992,737 B2 * 8/2011 Salice ..... B65D 43/169 215/235
8,003,966 B2 * 8/2011 Temus ..... G21F 5/08 250/506.1
D660,093 S * 5/2012 Kyung ..... D7/629
8,231,023 B2 * 7/2012 Petyhyrycz ..... B65D 11/04 220/4.26
8,256,633 B2 * 9/2012 Rogers Martijena ..... B65D 1/0223 215/379
8,322,112 B2 * 12/2012 Luburic ..... C04B 38/08 249/185
8,342,428 B2 * 1/2013 Chu ..... B05B 9/0822 239/303
8,491,229 B2 * 7/2013 Cornelius ..... B65D 59/04 406/190
D688,920 S * 9/2013 Manley ..... D7/629
D691,480 S * 10/2013 Shukla ..... D24/104
8,573,425 B1 * 11/2013 Park ..... B65D 11/04 220/295
8,597,236 B2 * 12/2013 Nassiri ..... A61J 7/0046 206/217
8,807,385 B1 * 8/2014 Fosse ..... B65D 43/162 220/270
D720,809 S * 1/2015 Jour ..... D19/86
D723,333 S * 3/2015 Lin ..... D7/511
8,985,330 B1 * 3/2015 Normand ..... B65D 85/72 206/427
D741,115 S * 10/2015 Lane ..... D7/608
9,216,253 B2 * 12/2015 Spool ..... A61M 5/002
D747,606 S * 1/2016 Serell ..... D3/203.2
9,233,465 B2 * 1/2016 Lai ..... B65D 55/02
D760,601 S * 7/2016 Bochner ..... D9/542
D761,008 S * 7/2016 Lande ..... D3/203.2
2001/0035361 A1 * 11/2001 Mishiro ..... B65D 25/107 206/316.1
2002/0130126 A1 * 9/2002 Rosenberg ..... B65D 21/083 220/4.26
2005/0056561 A1 * 3/2005 Lai ..... A45C 5/08 206/373
2006/0191948 A1 * 8/2006 Wisniewski ..... B65D 43/164 220/831
2008/0179270 A1 * 7/2008 Thibaut ..... B65D 1/04 215/6
2008/0179334 A1 * 7/2008 Abramson ..... B01F 13/002 220/568
2010/0219185 A1 * 9/2010 Griffin ..... F16J 13/065 220/4.07
2011/0309083 A1 * 12/2011 Hsiu-Tzu Charlene ..... A45D 34/00 220/505
2012/0186528 A1 * 7/2012 Dorsey ..... A01K 1/0245 119/453
2014/0326273 A1 * 11/2014 Kalyanpur ..... A45D 40/24 132/314

* cited by examiner

DISPENSING CONTAINER WITH INTERIOR ACCESS

CROSS-REFERENCE TO RELATED APPLICATIONS

This application claims the benefit of priority of U.S. patent application Ser. No. 14/134,224, filed on Dec. 19, 2013, and titled "Container/Bottle with Interior Access", which is incorporated herein by reference in its entirety. Furthermore, this application serves as a continuation-in-part and improvements on the copending U.S. patent application Ser. No. 15/011,424, filed on Jan. 29, 2016.

STATEMENT REGARDING FEDERALLY SPONSORED RESEARCH OR DEVELOPMENT

"Not Applicable"

THE NAMES OF THE PARTIES TO A JOINT RESEARCH AGREEMENT

"Not Applicable"

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

"Not Applicable"

STATEMENT REGARDING PRIOR DISCLOSURES BY THE INVENTOR OR A JOINT INVENTOR

"Not Applicable"

BACKGROUND OF THE INVENTION

1. Field of the Invention

The present invention relates to a dispensing container. More specifically, the present invention relates to a dispensing container that allows its users to access all of its interior surfaces.

2. Description of Related Art

Dispensing containers used for solids, gels, pastes, cosmetics, condiments, all forms of viscous materials and any non liquid content, typically are small plastic containers that include a means for the dispensing of the content within the said container. A number of dispensing containers use gravity or applied pressure from the user by squeezing the container for the content to disperse from a small opening usually in the top of the container. Some of these dispensing containers may include spray pump or a hand pump that suctions the content through a straw-type tubing and then emits the content into the user's hand, onto the user's food, or on the surfaces being cleaned by the user with regard to any soap or cleaning content. The typical dispensing container may vary in size but usually contains a few ounces up to 20 or 30 ounces of fluid within the container for use. The common hand pump utilizes a straw-like tubing that extends downwardly into the dispensing container, many times the bottom surface of the dispensing container is flat and therefore the pump-type dispenser may leave unused content within the dispensing container. Most of the unused content is unable to be suctioned through to the tubing due to the positioning of the tube that extends into the dispensing container. Many times the tube is extended downward in the center of the dispensing container and functions in an efficient manner until a low level of content is left within the dispensing container. The interior walls of the dispensing container is also left with unused content. It would therefore be advantageous to have a dispensing container that permits its users to access all of its interior surfaces once its normal dispensing process can no longer disperse its remaining content.

BRIEF SUMMARY OF THE INVENTION

Applicants' invention comprises further improvements in the configuration of the finished dispensing container and in the manufacture of the finished dispensing container to provide its users access to all of its interior surfaces. The purpose of a dispensing container with interior access is for when the said dispensing container can no longer disperse the low level content within its bottom surface and interior walls through its normal dispensing process.

Applicants' dispensing container with interior access (100) comprises of: a container (100), where said container (100) is structured in two halves (1/2), an upper half (1) and a lower half (2), adjoined by a pivoting hinge (3) to hold the two halves (1/2) together with the following combination of locking components on the lower half (2) of the dispensing container with interior access (100); a front lower snap bump (8), a left lower snap bump (12), a right lower snap bump (11), and lower radial snap bumps (5) that serve as the tongues and the following combination of locking components on the upper half (1) of the dispensing container with interior access (100); a left upper snap (4), a front upper snap (6), a right upper snap (10), and an upper radial snapping rim (9) that serve as the grooves; and additional locking and unlocking components, wherein the additional locking and unlocking components are distributed across the lower half (2) of the dispensing container with interior access (100) comprises of a front lower relief indentation (15), a right lower relief indentation (14), a left lower relief indentation (13), and a seal (7); wherein the lower relief indentations (13/14/15) allow fingers to grab under the upper snaps (4/6/10) for easy separation of the the lower half (2) and upper half (1) of the dispensing container with interior access (100).

BRIEF DESCRIPTION OF THE SEVERAL VIEWS OF THE DRAWING(S)

The present disclosure, in accordance with one or more embodiments, is described in detail with reference to the following figures. The drawings are provided for purposes of illustration only and merely depict typical or example embodiments. These drawings are provided to facilitate the reader's understanding of the apparatus and methods and shall not be considered limiting of the breadth, scope, or applicability of the invention. It should be noted that for clarity and ease of illustration these drawings are not necessarily made to scale.

Figure 1B:
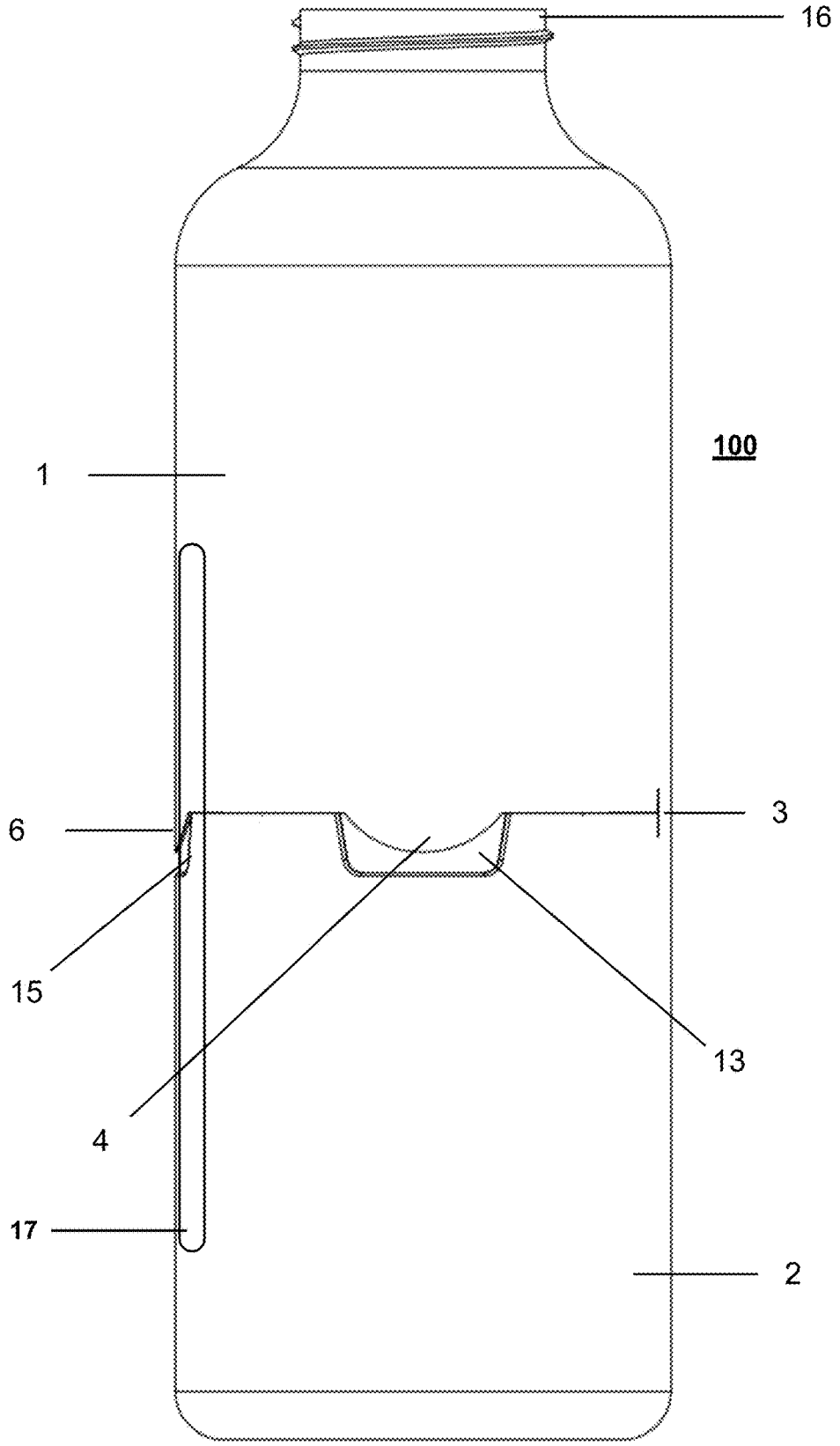
Figure 1C:
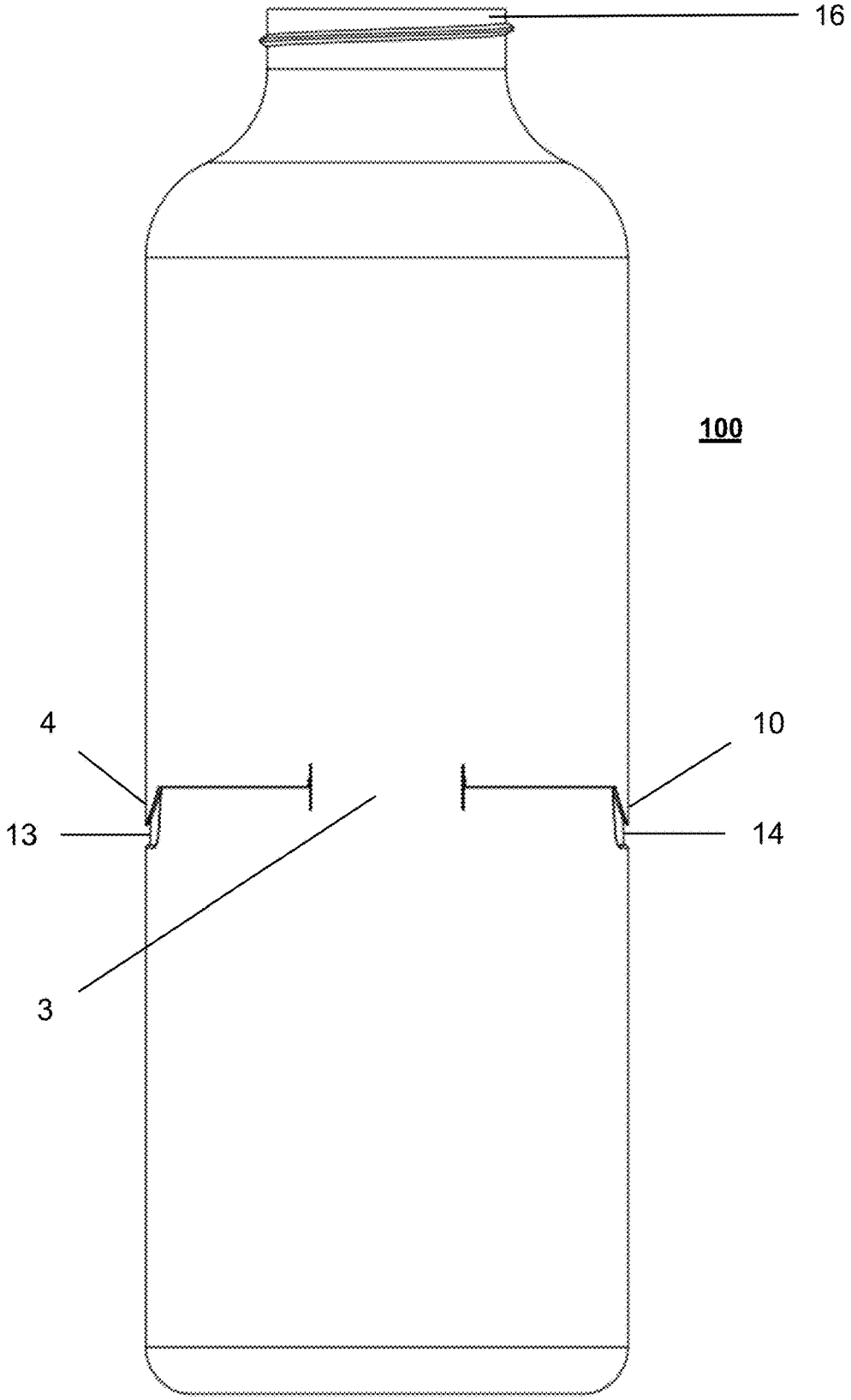
Figure 2A:
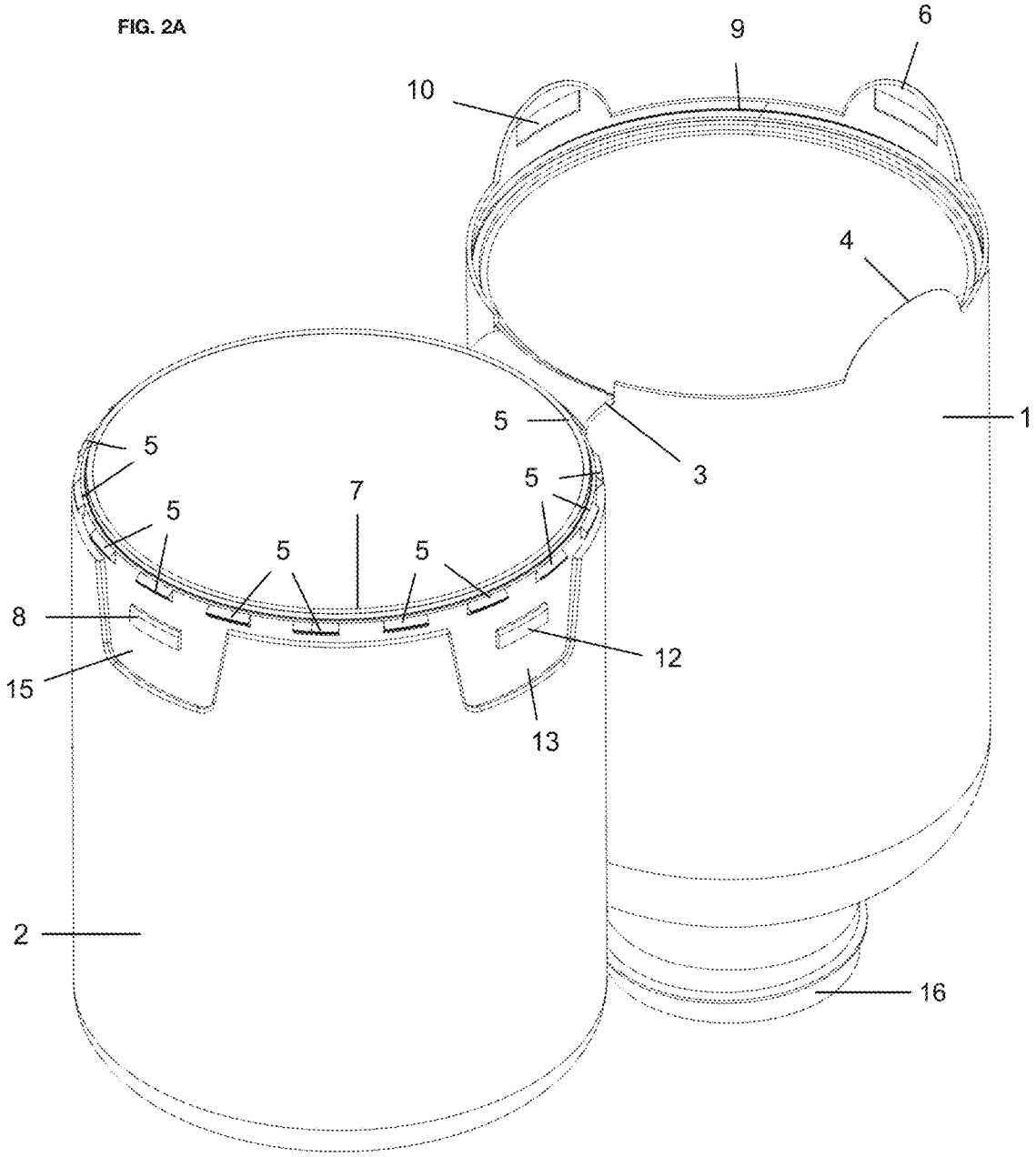
Figure 2B:
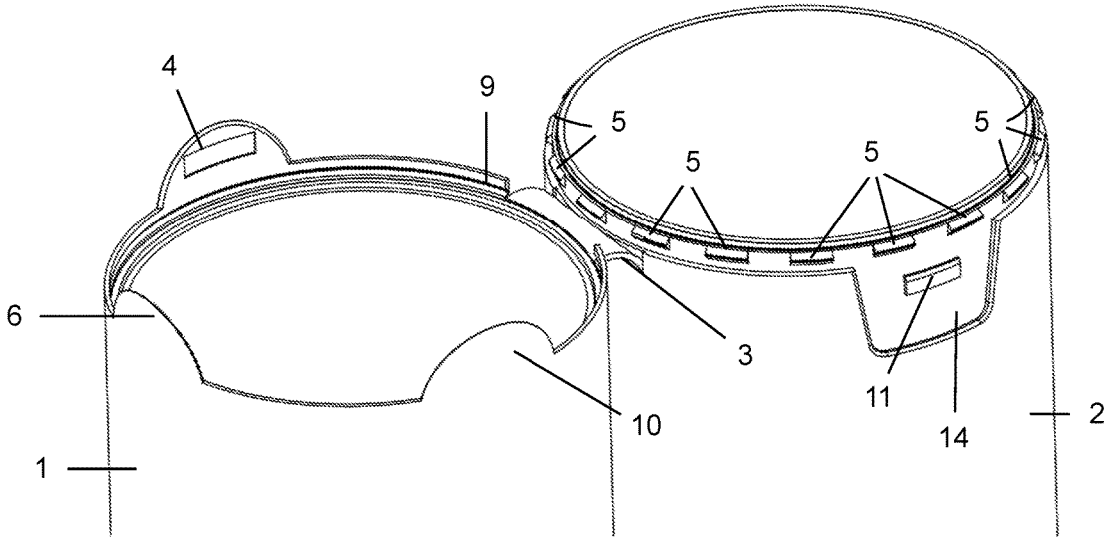
Figure 2C:
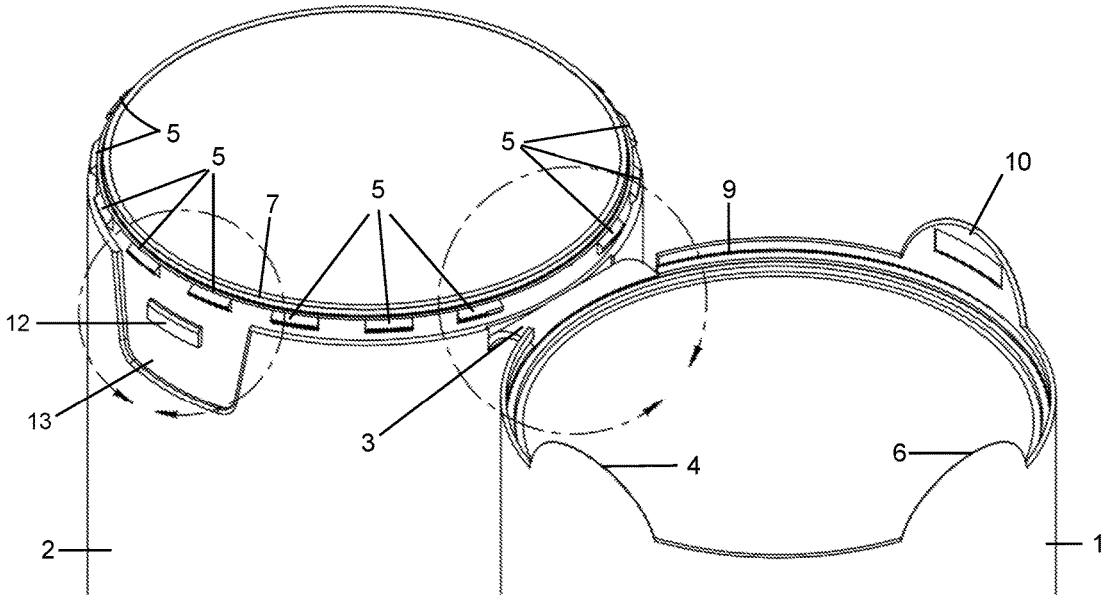
Figure 2D:
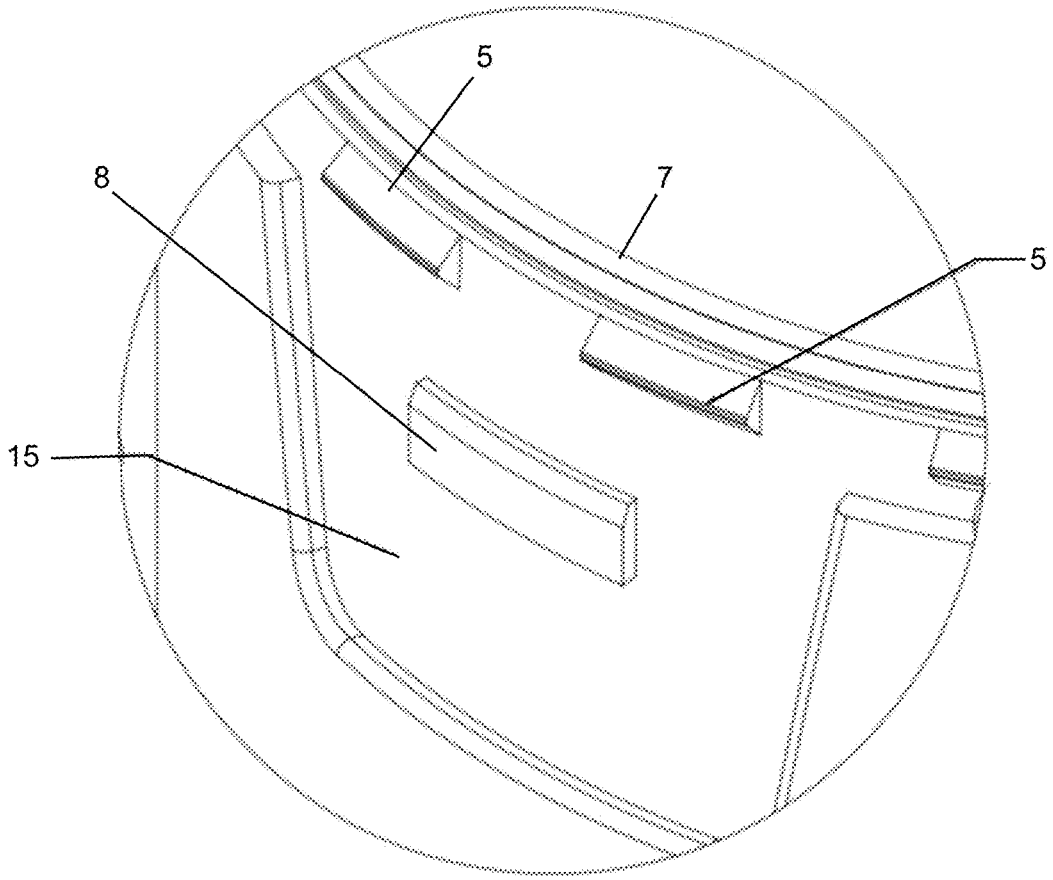
Figure 2E:
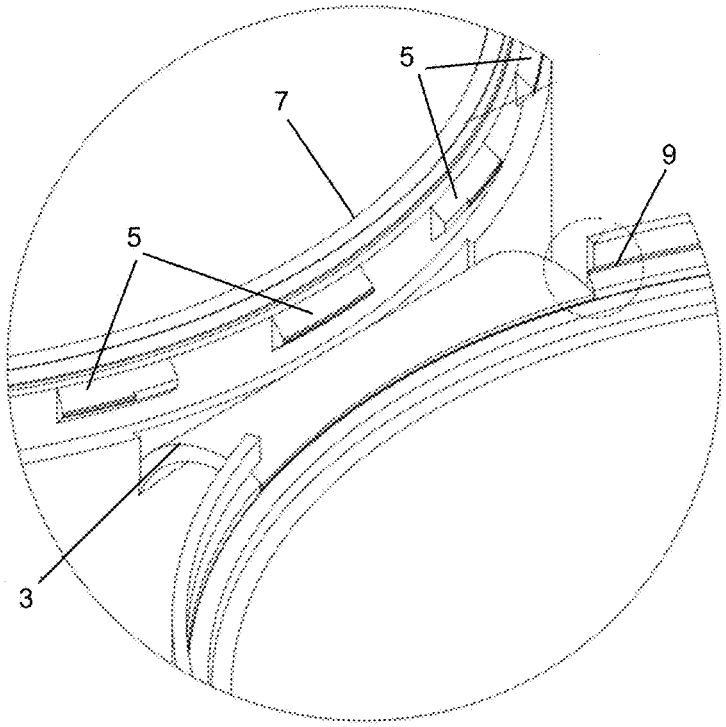
Figure 2F:
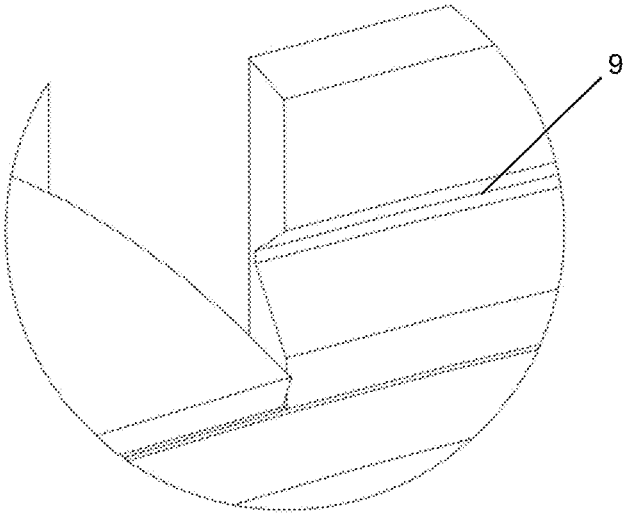
Figure 3A:
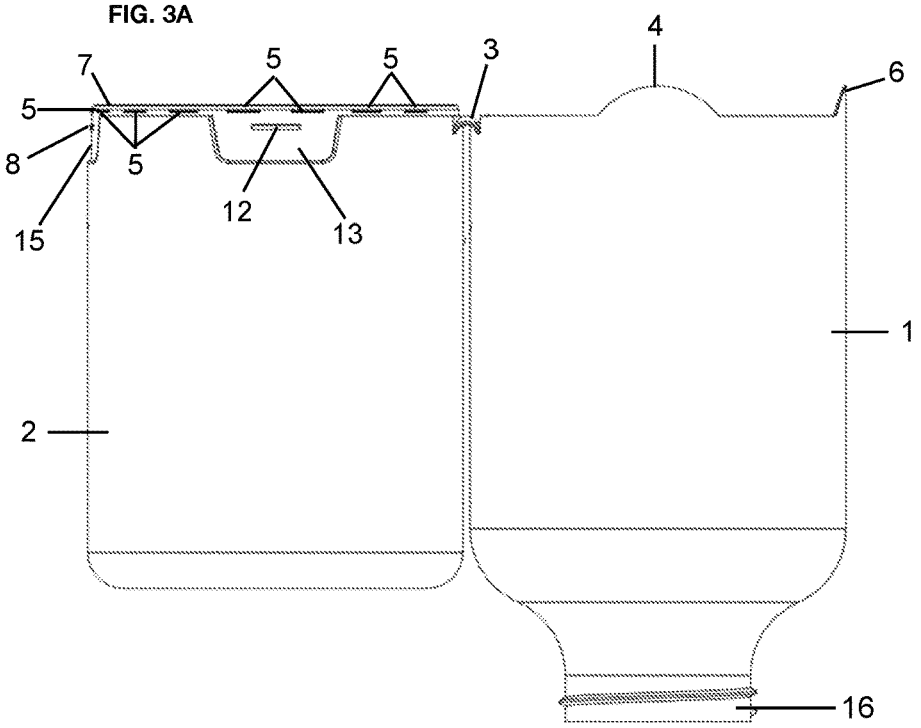
Figure 3B:
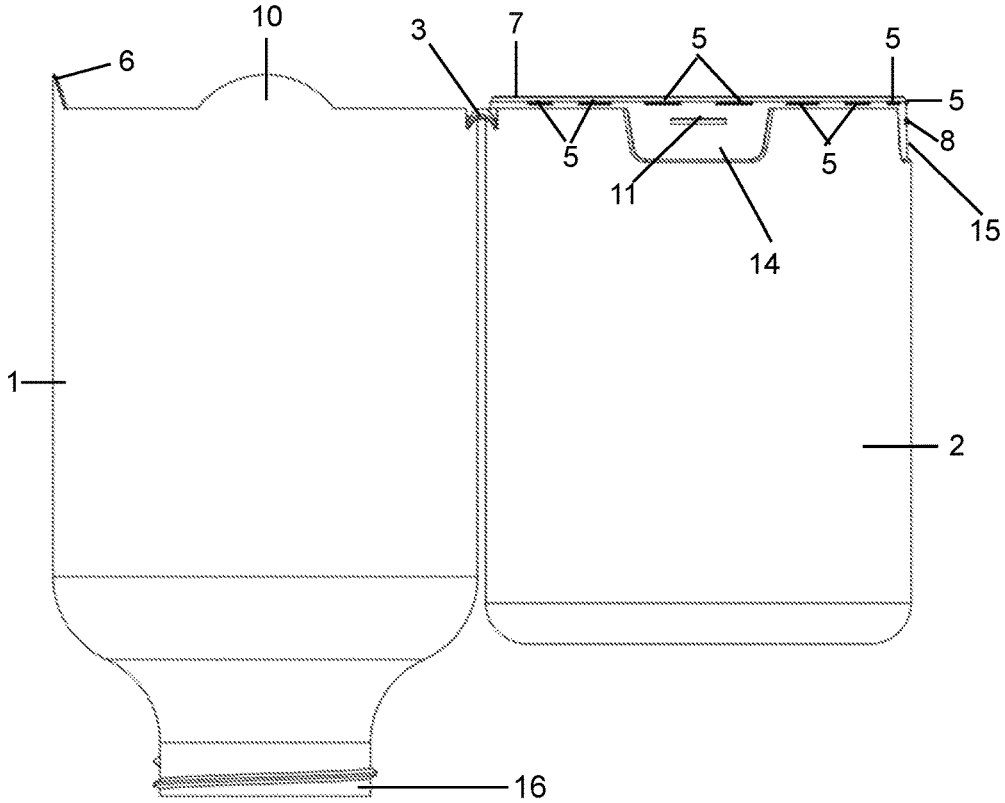
Figure 3C:
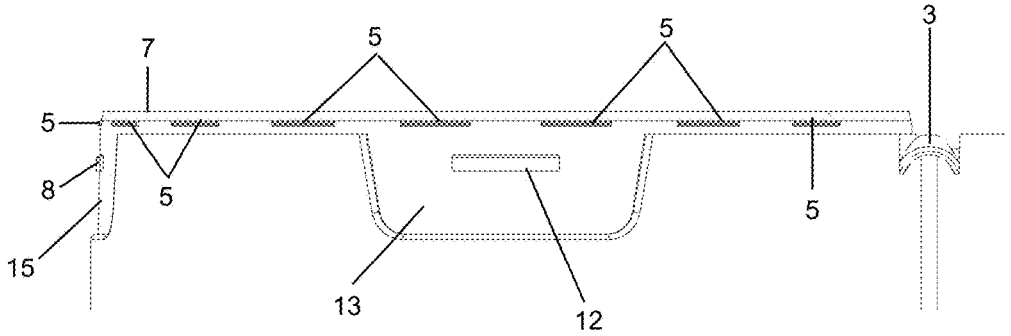
Figure 3D:
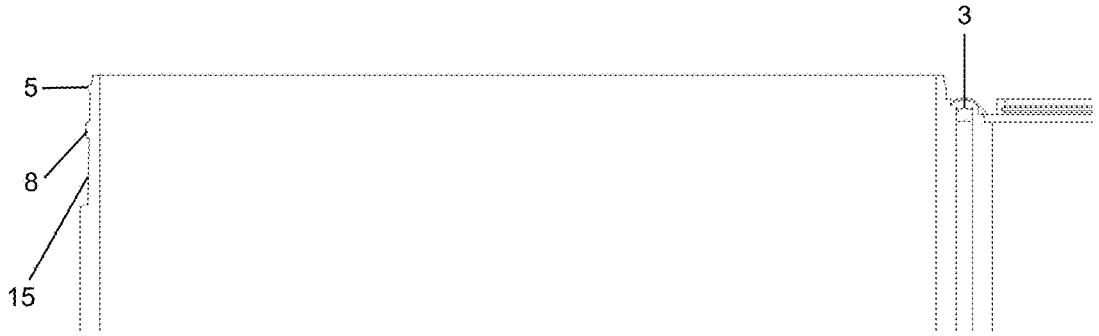
Figure 3E:
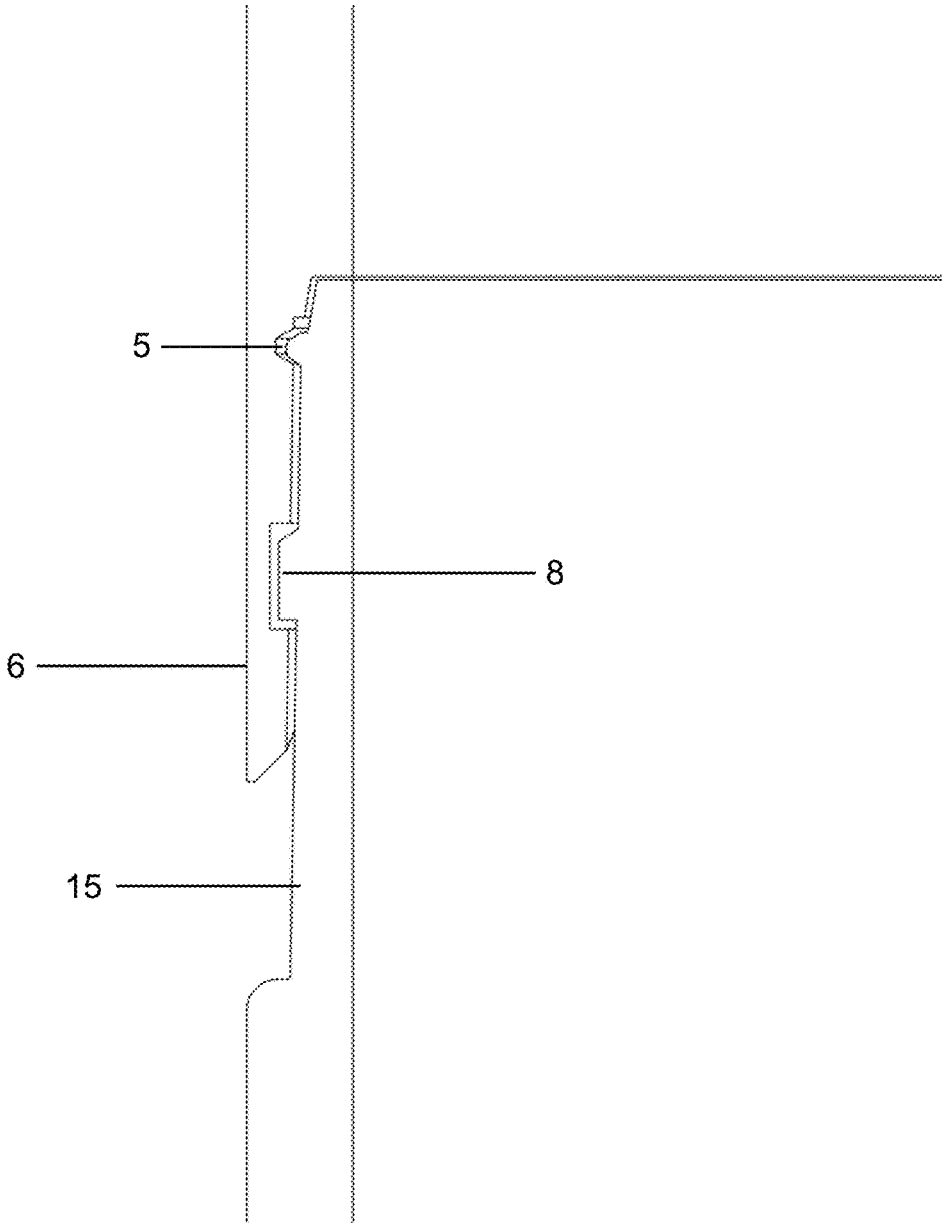
Figure 4A:
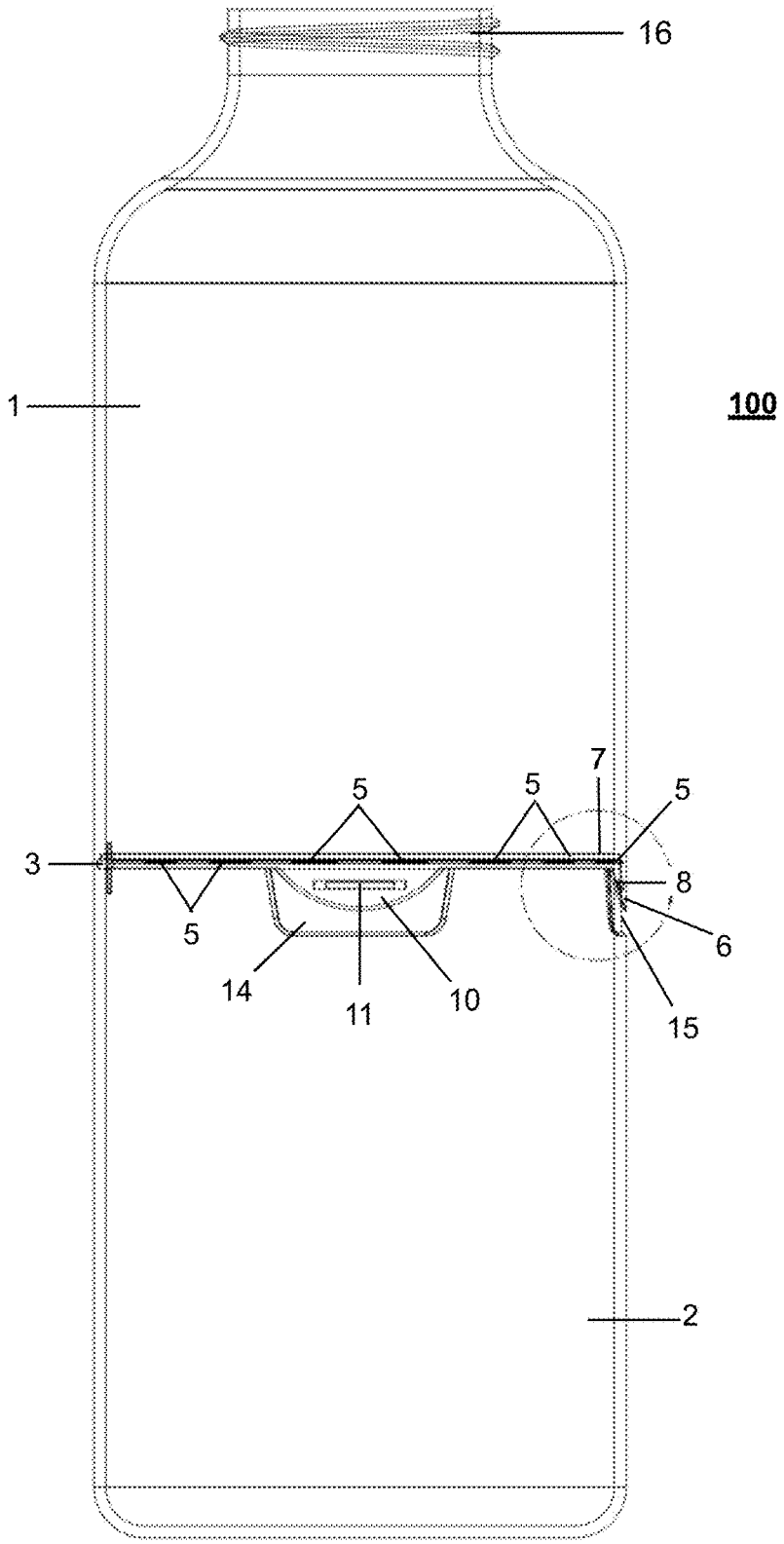
Figure 4B:
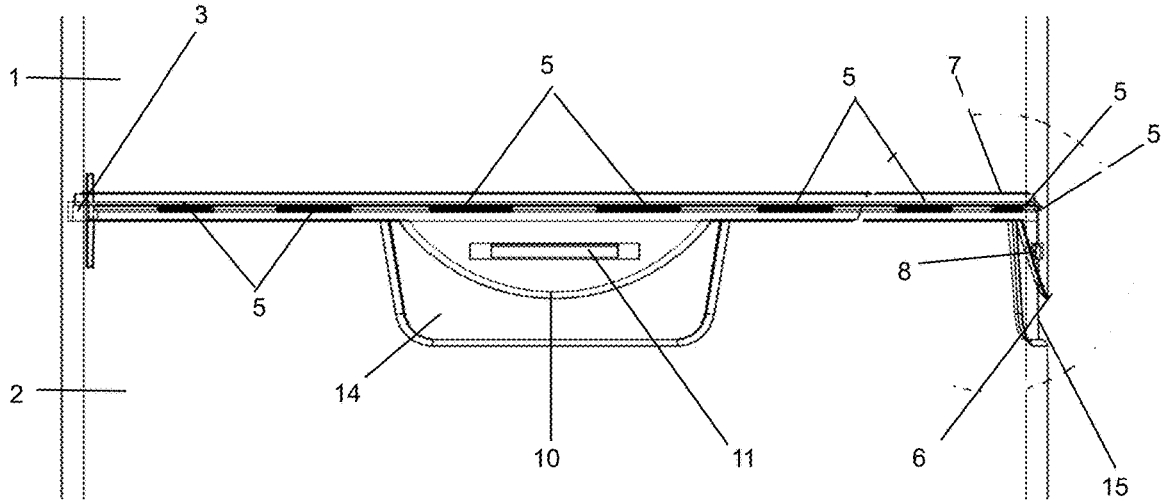
Figure 4C:
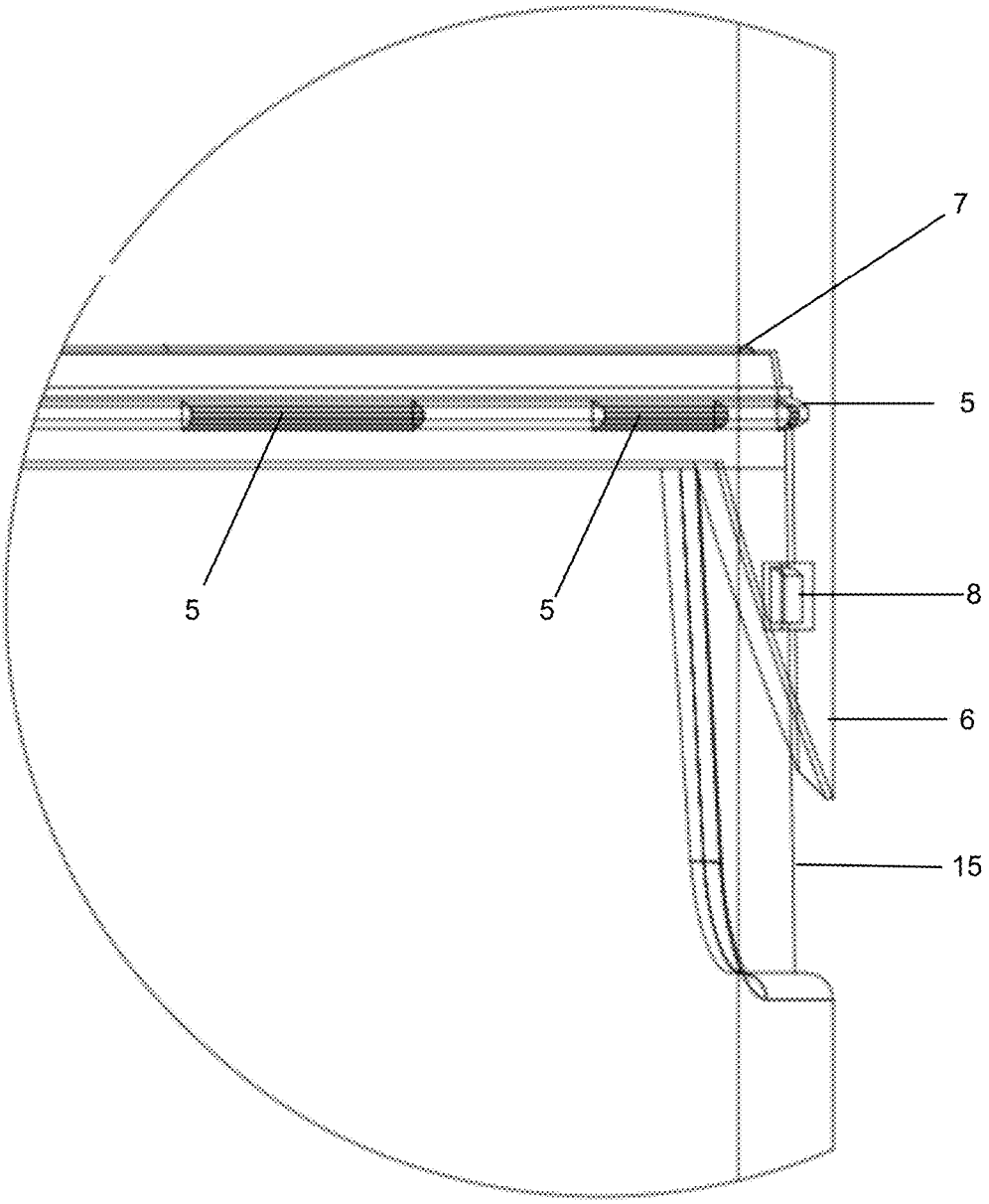
Figure 4D:
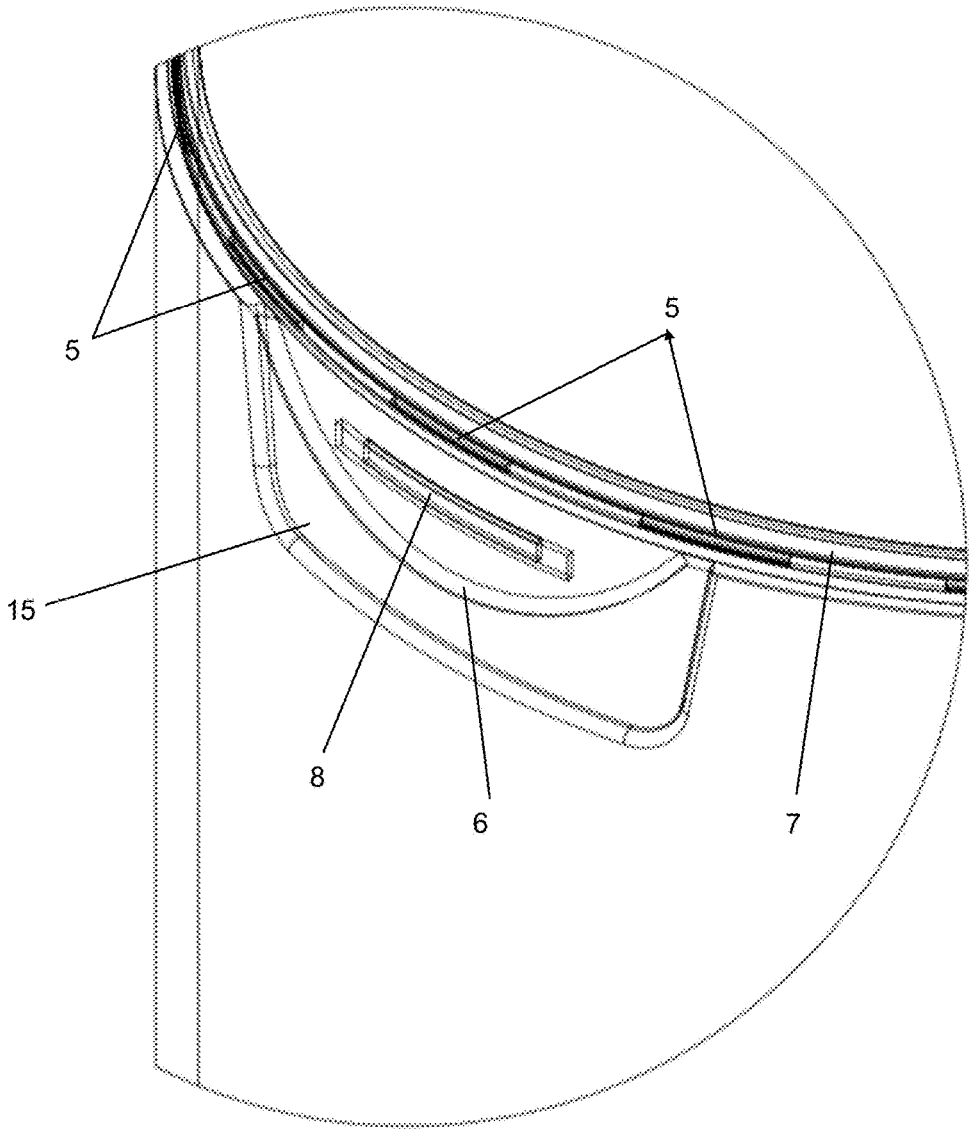

FIGS. 1*a-c* are drawings of a perspective, side, and rear view of a dispensing container with interior access (100) with two halves (1/2), an upper half (1) and a lower half (2) in a closed position adjoined through the embodiment of a pivoting hinge (3) along with locking components (4/6/10) and unlocking components (13/14/15) with an open inner rim mouth (16) and an area for a logo (17) in accordance with the embodiment of the present disclosure;

FIGS. 2*a-f* are drawings of perspective and side views of a dispensing container with interior access (100) with two halves (½) in an open position in accordance with the embodiment of the present disclosure;

FIGS. 3*a-e* are drawings of side views of a dispensing container with interior access (100) in an open and closed position in accordance with an embodiment of the present disclosure;

FIGS. 4*a-d* are drawings of perspective and side views of a dispensing container with interior access (100) in a locked position in accordance with an embodiment of the present disclosure;

Some of the figures included herein illustrate various embodiments from different viewing angles. Although the accompanying descriptive text may refer to such views as "side" views, such references are merely descriptive and do not imply or require that all embodiments be implemented or used in a particular spatial orientation unless explicitly stated otherwise.

The figures are not intended to be exhaustive or to limit the embodiments to the precise form disclosed. It should be understood that the various embodiment can be practiced with modification and alteration, and that the invention is limited only by the claims and the equivalents thereof.

DETAILED DESCRIPTION OF THE INVENTION

The embodiments described herein are exemplary. Descriptions in terms of these embodiments is provided to allow various features to be portrayed in the context of an exemplary application. As will be clear to one of ordinary skill in the art, the invention can be implemented in different and alternative embodiments without departing from the spirit or scope of the invention.

Unless defined otherwise, all terms used herein have the same meaning as is commonly understood by one of ordinary skill in the art to which this invention belongs.

The current dispensing container on the market today lacks the design and functionality to release and allow complete access to its viscous content. When the said dispensing container can no longer disperse its content the consumer is burdened by not having full access to the content they purchased and the environment is burdened by the possibility of contamination of disposed dispensing containers that may have remaining chemical content in them.

When the current markets dispensing container can no longer disperse its remaining content for the consumer the consumer does not reap the full benefits of the said product. If the consumer chooses to use alternative methods to access the remaining content that could not be dispersed such as: warming up, cutting open, or even placing the dispensing container in an upside down position for the content to eventually surface, the consumer runs the potential risk of direct or indirect harm and time wasted without the guarantee of achieving complete access to the said content nor preserving it if the dispensing container is cut open.

Another potential risk that the current dispensing container bears is environmental contamination. When consumers dispose of their dispensing containers that have remaining chemical content in the said dispensing container can have a direct and indirect effect on the environment at large.

To achieve better usage the present invention relates to a dispensing container that improves the performance of a hand pump and squeeze style dispensing container. The dispensing container according to the present invention utilizes unique features within the interior and exterior of the container to ensure complete access to the content through the use of a secured open, close, lock, and seal system within the dispensing container.

DETAILED DESCRIPTION OF THE INVENTION

The present invention is a dispensing container with interior access 100 that includes two halves 1,2, an upper half 1, a lower half 2, a pivoting hinge 3 and locking components 4,5,6,8,9,10,11,12 and unlocking components 13,14,15 that allows the dispensing container with interior access 100 to open through the center of the upper half 1 and lower half 2 of the dispensing container with interior access 100 for interior access to any remaining content that its normal dispensing process could not disperse through a an open inner rim mouth 16 or dispensing pump.

In addition, there is a seal 7 that will prevent content from seeping once the upper half 1 and the lower half 2 are adjoined and secured by the pivoting hinge 3 and locking components 4,5,6,8,9,10,11,12.

FIGS. 1*a-c* and FIGS. 2*a-f* depict dispensing container with interior access 100 in accordance with the teachings of the present disclosure. Dispensing container with interior access 100 comprises of two halves, an upper half 1 and lower half 2, with an incorporated pivoting hinge 3, front lock components comprising of lower radial snap bumps 5, a front lower snap bump 8, and a front upper snap 6, with an unlocking component comprising of a front lower finger relief indentation 15 opposite of the pivoting hinge 3, and multiple snap bumps; a right lower snap bump 11 and a left lower snap bump 12, and multiple snaps; a left upper snap 4, a right upper snap 10, and an upper snapping rim 9, and multiple indentations; a left lower finger relief indentation 13 and a right lower finger relief indentation 14, and an integral seal 7 feature 90 degrees from the pivoting hinge 3 functions in the capacity to assist with opening, closing, locking, and unlocking the dispensing container with interior access 100.

In an embodiment a logo 17, symbol, mark, or other design feature may be placed, embossed, or molded onto the upper half 1, lower half 2 or both halves 1,2 of the dispensing container with interior access 100 without effecting the opening and closing of the dispensing container with interior access 100. Additionally, and/or alternatively, either the upper half 1, lower half 2 or both halves 1,2 may be covered by a decorative shell made of metal, plastic, ceramic, or glass.

Dispensing container with interior access 100 may be round, square, octagonal, triangular or any other geometric shape. It may contain one lock or multiple locks, one or multiple pivoting hinges 3, one or more seals 7, It may have one or more snaps 4,6,9,10, one or more snap bumps 5,8,11,12, and one or more indentations 13,14,15.

DETAILED DESCRIPTION OF THE INVENTION (CONTINUED)

Dispensing container with interior access 100 may be made from plastic, metal, ceramic, glass, or any other rigid material. In an embodiment, the upper half 1 and lower half 2 of the dispensing container with interior access 100 may be disengaged by lifting the following lock components; the left upper snap 4, the front upper snap 6, the right upper snap 10, and the upper radial snapping rim 9 in an upwardly direction from the lower radial snap bumps, front lower snap bump 8, right lower snap bump 11, and left lower snap bump 12, with the assistance of the left lower finger relief indentation 13, right lower finger relief indentation 14, front lower finger relief indentation 15, and the pivoting hinge 3. In an embodiment multiple snaps 4, 6, 9, 10, multiple snap bumps 5,8,11,12 with multiple indentations 13,14,15, along with a pivoting hinge 3 can open and close the dispensing container with interior access 100. In another embodiment multiple snaps 4, 6, 9, 10, multiple snap bumps 5,8,11,12 with multiple indentations 13,14,15, along with a pivoting hinge 3 may have specific locations on the center body of the dispensing container with interior access 100 and be sensitive to pressure and the location on the multiple snaps 4, 6, 9, 10, multiple snap bumps 5,8,11,12 with multiple indentations 13,14,15, along with the pivoting hinge 3 where pressure is applied or the amount of pressure applied, i.e, how deep the multiple snaps 4, 6, 9, 10, multiple snap bumps 5,8,11,12 with multiple indentations 13,14,15, are pressed, may open the dispensing container with interior access 100. In still another embodiment, multiple snaps 4, 6, 9, 10, multiple snap bumps 5,8,11,12 with multiple indentations 13,14,15, along with the pivoting hinge 3 may open the dispensing container with interior access 100 and close the dispensing container with interior access 100 by sliding to a first position or a second position. That is, the multiple snaps 4, 6, 9, 10, multiple snap bumps 5,8,11,12 with multiple indentations 13,14,15, along with the pivoting hinge 3 may open the dispensing container with interior access 100 by sliding rather than lifting. For example and not limitation, the multiple snaps 4, 6, 9, 10, multiple snap bumps 5,8,11,12 with multiple indentations 13,14,15, along with a pivoting hinge 3 for example could be slid left to unlock and open the dispensing container with interior access 100 and right to close and lock the dispensing container with interior access 100 or vice versa. In still another embodiment, the multiple snaps 4, 6, 9, 10, multiple snap bumps 5,8,11,12 with multiple indentations 13,14,15, along with a pivoting hinge 3 may be activated by pressing, sliding (up/down or side to side), rotating, pulling and/or pushing, twisting or a combination of these multiple snap bumps 5,8,11,12 with multiple indentations 13,14,15, along with a pivoting hinge 3 for example could be slid

DETAILED DESCRIPTION OF THE INVENTION (CONTINUED)

left to unlock and open the dispensing container with interior access 100 and right to close and lock the dispensing container with interior access 100 or vice versa.

In still another embodiment, the multiple snaps 4, 6, 9, 10, multiple snap bumps 5,8,11,12 with multiple indentations 13,14,15, along with a pivoting hinge 3 may be activated by pressing, sliding (up/down or side to side), rotating, pulling and/or pushing, twisting or a combination of these.

FIGS. 3*a-e* and FIGS. 4*a-d* depicts dispensing container with interior access 100 in an unlocked and locked position. Dispensing container with interior access 100 may have upper half 1, lower half 2, multiple snaps 4, 6, 9, 10, multiple snap bumps 5,8,11,12, multiple indentations 13,14,15, seal 7, and pivoting hinge 3 couples the upper half 1 to the lower half 2 of the dispensing container with interior access 100 and allows the upper half 1 to open approximately 90 degrees. Upper half 1 may open to less than approximately 90 degrees or greater than approximately 90 degrees, such as, for example, to approximately 95 degrees, approximately 100 degrees, approximately 105 degrees, approximately 110 degrees, approximately 120 degrees, approximately 125 degrees, approximately 130 degrees, approximately 135 degrees, approximately 140 degrees, approximately 145 degrees, approximately 150 degrees, or greater than 150 degrees.

The upper half 1 of the dispensing container with interior access 100 remains in a closed position until the multiple snaps 4, 6, 9, 10 are lifted upwards from the multiple snap bumps 5,8,11,12 through the assistance of the multiple indentations 13,14,15, along with a pivoting hinge 3. The multiple snaps 4, 6, 9, 10, multiple snap bumps 5,8,11,12, multiple indentations 13,14,15, may be any standard type of snap locking system that engages the multiple snaps 4, 6, 9, 10 with the multiple snap bumps 5,8,11,12. It may have a inverted lip, raised edge, bevel, tongs, or any other engagement mechanism to remain engaged with the multiple snaps 4, 6, 9, 10 and multiple snap bumps 5,8,11,12.

The seal 7 is securely integrated on the top lip of the lower half 2 of the dispensing container with interior access 100 and is configured to be of a sufficient size, weight, and thickness to hold the desired viscous content, such that when both the upper half 1 and lower half 2 of the dispensing container with interior access 100 are adjoined and secured by the means of multiple snaps 4, 6, 9, 10, multiple snap bumps 5,8,11,12, and a pivoting hinge 3 the center body of the dispensing container with interior access 100 will not experience seepage.

DETAILED DESCRIPTION OF THE INVENTION (CONTINUED)

Those skilled in the art will recognize that the present teachings are amenable to a variety of modifications and/or enhancements. For example, although the implementation of various snap components described above may be embodied as described, they may also be arranged in different embodiments, where for example, the multiple snaps 4, 6, 9, 10, multiple snap bumps 5,8,11,12, and multiple indentations 13,14,15, are arranged in opposite directions, i.e., both facing upwardly or one up and one down. Also, with regards to the implementation of the pivoting hinge 3 and seal 7, they may be arranged in different embodiments, where for example, the pivoting hinge 3 may be arranged on the right side or left side of the dispensing container with interior access 100 and the seal 7 may be arranged on the upper half 1, lower half inner rim, or even the affixed to the exterior of the dispensing container with interior access 100

While the foregoing has described what are considered to be the best mode and/or other examples, it is understood that various modifications may be made therein and that the subject matter disclosed herein may be implemented in various forms and examples, and that the teachings may be applied in numerous applications, only some of which have been described herein. It is intended by the following claims to claim any and all applications, modifications and variations that fall within the true scope of the present teaching.

What is claimed:

1. A dispensing container with interior access (100) comprising:

two container halves (1 and 2), wherein the two halves (1 and 2) include, an upper half (1), which has an open bottom lip with an upper radial snapping rim (9) and an open inner rim mouth (16) for receiving a dispensing cap, a lower half (2), which has a closed bottom and an open top lip with a radial seal (7);

a pivoting hinge (3) which connects the upper half (1) and the lower half (2) of the dispensing container with interior access (100) together;

a front upper snap (6), a left upper snap (4), a right upper snap (10) and the upper radial snapping rim (9) are defined as recessed grooves;

a front lower snap bump (8) which is positioned within a front lower relief indentation (15), a left lower snap bump (12) which is positioned within a left lower relief indentation (13), a right lower snap bump (11) which is positioned within a right lower relief indentation (14), and lower radial snap bumps (5) are defined as protruding tongues;

in a closed container position, the front upper snap (6) is affixed to the front lower snap bump (8), the left upper snap (4) is affixed to the left lower snap bump (12), the right upper snap (10) is affixed to the right lower snap bump (11), and an upper radial snapping rim (9) is affixed to the lower radial snap bumps (5), wherein in the closed position the upper half (1) and lower half (2) of the dispensing container with interior access (100) are locked and sealed with the pivoting hinge (3) being positioned opposite the front upper snap (6);

in the closed container position the front lower relief indentation (15), the right lower relief indentation (14) and the left lower relief indentation (13) each create a gap with the front upper snap (6), the right upper snap (10) and the left upper snap (4) for allowing a user to detach the upper half (1) and the lower half (2); and wherein the seal (7) is securely integrated on the open top lip of the lower half (2) of the dispensing container with interior access (100) to properly seal the dispensing container with interior access (100) when the upper half (1) and lower half (2) are in the closed position.

2. The dispensing container with interior access (100) as claimed in claim 1, wherein the open inner rim mouth (16) includes a dispensing cap.

3. The dispensing container with interior access (100) as claimed in claim 1, wherein at least one of a logo, symbol, mark, and other design feature is at least placed, embossed, and molded onto either or both halves of the container (1 and 2) without effecting the opening and closing of the dispensing container with interior access (100).

4. The dispensing container with interior access (100) as claimed in claim 1, wherein the upper half (1) and the lower half (2) are made of at least one of a plastic, a metal, a ceramic, a glass, and any other rigid material.

5. The dispensing container with interior access (100) as claimed in claim 1, wherein at least one of the upper half (1) and the lower half (2) is covered by a decorative shell made of at least one of a plastic, a metal, a ceramic, a glass, and any other rigid material.

* * * * *